US006439306B1

(12) United States Patent
Patel

(10) Patent No.: US 6,439,306 B1
(45) Date of Patent: Aug. 27, 2002

(54) ACTUATION OF DOWNHOLE DEVICES

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/507,481

(22) Filed: Feb. 17, 2000

Related U.S. Application Data

(60) Provisional application No. 60/120,864, filed on Feb. 19, 1999.

(51) Int. Cl.[7] ..... E21B 49/08

(52) U.S. Cl. ..... 166/264; 166/164; 166/169; 166/317

(58) Field of Search ..... 166/264, 317, 166/169, 164, 66.4, 66.7

(56) References Cited

U.S. PATENT DOCUMENTS

| | | | | | |
|---|---|---|---|---|---|
| 3,095,930 | A | * | 7/1963 | Kisling, III | 166/264 |
| 3,227,228 | A | | 1/1966 | Bannister | |
| 4,576,234 | A | * | 3/1986 | Upchurch | 166/319 |
| 4,597,439 | A | * | 7/1986 | Meek | 166/163 |
| 4,609,005 | A | * | 9/1986 | Upchurch | 137/68.1 |
| 4,697,638 | A | | 10/1987 | Knight | |
| 4,796,699 | A | | 1/1989 | Upchurch | |
| 4,856,595 | A | | 8/1989 | Upchurch | |
| 4,896,722 | A | | 1/1990 | Upchurch | |
| 4,915,168 | A | | 4/1990 | Upchurch | |
| B14,915,168 | A | | 4/1990 | Upchurch | |
| 4,971,160 | A | | 11/1990 | Upchurch | |
| 5,050,675 | A | | 9/1991 | Upchurch | |
| 5,058,674 | A | | 10/1991 | Schultz et al. | |
| 5,103,906 | A | * | 4/1992 | Schultz et al. | 166/264 |
| 5,146,983 | A | * | 9/1992 | Hromas | 166/65.1 |
| 5,240,072 | A | | 8/1993 | Schultz et al. | |
| 6,065,355 | A | * | 5/2000 | Schultz | 73/864 |

* cited by examiner

*Primary Examiner*—Hoang Dang
(74) *Attorney, Agent, or Firm*—Dan C. Hu; Jeffrey E. Griffin; Brigitte L. Jeffery

(57) ABSTRACT

A tool string for use in wellbore includes a sampler device having a port to receive pressure in an annulus region of the wellbore. An elevated pressure is communicated to a rupture disk assembly located in the port to rupture the rupture disk assembly. The elevated pressure is then communicated through a passageway to an activating mechanism of a sampler device. The activating mechanism is adapted to open a flow control device that controls flow through one or more ports of the sampler device. In another arrangement, the activating mechanism of the sampler device may include a pressure transducer for receiving pressure pulse signals. In response to pressure pulse signals of predetermined amplitude and pulse width, the pressure transducer may generate an activating signal to an actuator to operate the flow control device. Yet another arrangement includes a timer for activating the sampler device. The timer is actuatable by an elevated pressure. However, a rupture disk assembly is positioned to block communication of fluid pressure to the timer until the rupture disk assembly is ruptured.

22 Claims, 7 Drawing Sheets

ACTUATION OF DOWNHOLE DEVICES

This application claims priority under 35 U.S.C. § 119(e) to U.S. Provisional Application Ser. No. 60/120,864, entitled, "Actuation of Downhole Devices," filed on Feb. 19, 1999.

BACKGROUND

The invention relates to actuation of downhole devices in a wellbore including actuation of downhole sampler devices.

After a wellbore has been drilled, it is desired to perform tests of formations surrounding the wellbore. Logging tests may be performed, and samples of formation fluids may be collected for chemical and physical analyses. The information collected from logging tests and analyses of properties of sampled fluids may be used to plan and develop wellbores and for determining their viability and potential performance.

Samples of fluids in a wellbore may be taken with downhole sampler devices, such as monophasic sampler devices. A sampler device may be lowered into a wellbore on a wireline cable or other carrier line (e.g., a slickline or tubing). Such a sampler device may be actuated electrically over the wireline cable after the sampler device reaches a certain depth. Once actuated, the sampler device is able to receive and collect downhole fluids. After sampling is completed, the sampler device can then be shut off and retrieved to the surface where the collected downhole fluids may be analyzed.

In some test strings, sampler devices may be attached at the end of a non-electrical cable, such as a slickline. To actuate such sampler devices, an actuating mechanism including a timer may be used. The timer may be set at the surface to expire after a set time period to automatically actuate the sampler devices. The set time period may be greater than the expected amount of time to run the test string to the desired depth.

However, a timer-controlled actuating mechanism may not provide the desired level of controllability. In some cases, the timer may expire prematurely before the test string including the sampler devices is lowered to a desired location. This may be caused by unexpected delays in assembling the test string in the wellbore. If prematurely activated, the sampler devices are typically retrieved back to the surface and the test string re-run, which may be associated with significant costs and delays in well operation.

Thus, a need exists for an improved actuation technique for sampler devices and other downhole devices and tools in a wellbore.

SUMMARY

In general, according to one embodiment, a downhole tool includes a sampler device having one or more ports, a flow control device to control flow through the one or more ports, and an activating mechanism to control the flow control device. An assembly includes a rupture disk assembly and a fluid path between the rupture disk mechanism and the activating mechanism. The rupture disk mechanism is adapted to block communication of the fluid pressure to the activating mechanism.

In general, according to another embodiment, a tool for use in a wellbore includes one or more sampler devices and one or more activating mechanisms operatively coupled to one or more sampler devices. Each of the one or more activating mechanisms includes a pressure transducer to receive pressure pulse signals.

Other features and embodiments will become apparent from the following description, the claims, and the drawings.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, although reference is made to actuation of sampler devices, it is contemplated that other types of downhole devices may be used with further embodiments.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
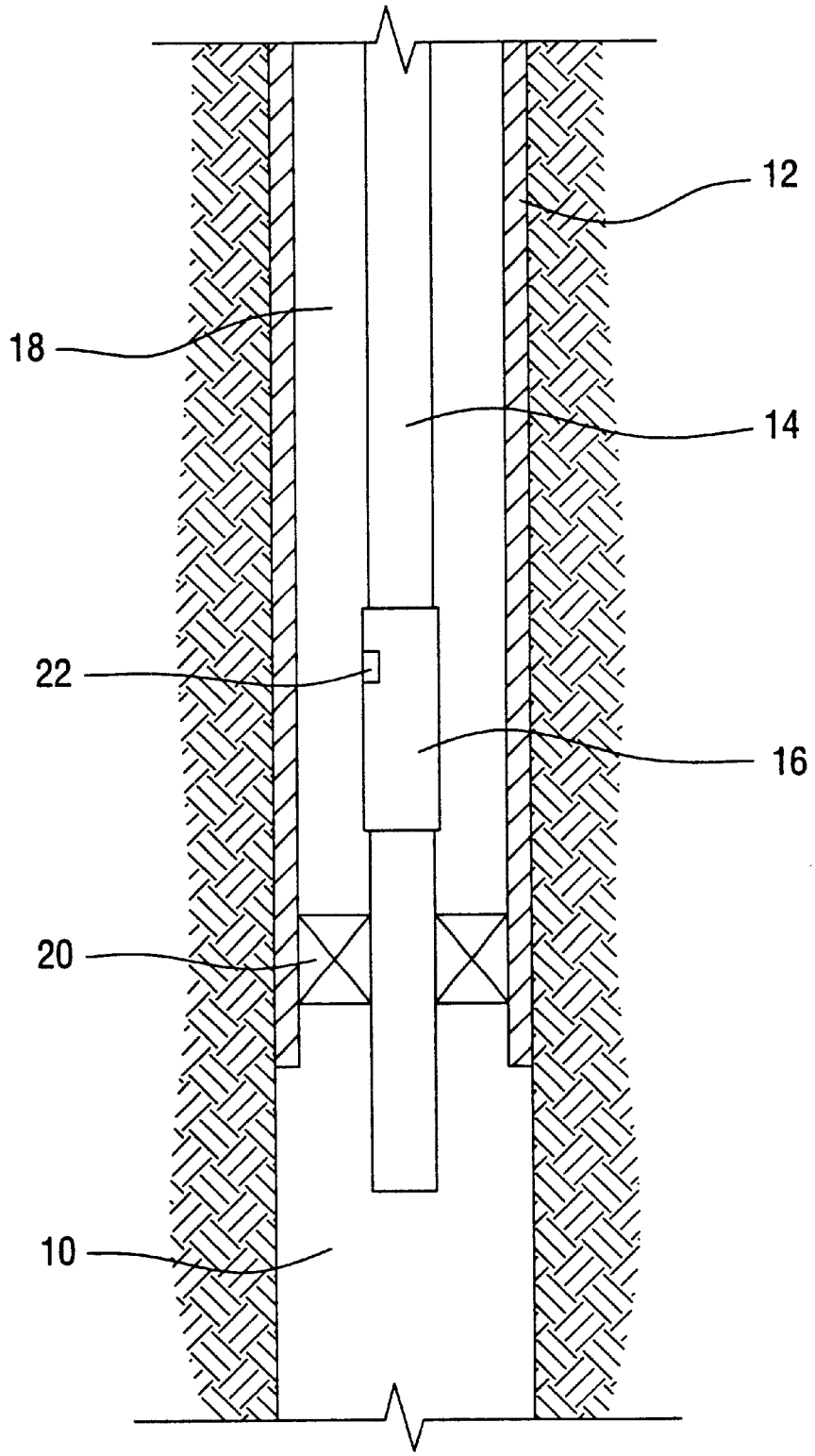
FIG. 1 illustrates an embodiment of a test string including a sampler tool positioned in a wellbore.

Referring to FIG. 1, a test string (e.g., a drill stem test string) includes a sampler tool 16, which may include one or more sampler devices, that is attached to the end of a tubing 14 positioned in a wellbore 10. In the illustrated embodiment, the wellbore 10 is lined with casing 12. An annular region 18 is defined between the inner wall of the casing 12 and the outer wall of the tubing 14. A packer 20 may be positioned to isolate the annular region 18 from fluids below the packer 20.

According to some embodiments, the sampler tool 16 includes a port 22 to receive fluid pressure applied down the annular region 18 from the surface. The fluid pressure, when elevated to above some predetermined level, may be used to actuate one or more sampler devices in the sampler tool 16. Other actuating mechanisms may also be provided in further embodiments, such as pressure pulse signal activated mechanisms and timer mechanisms. Yet other embodiments of sampler tools may include sampler devices with more than one type of activating mechanism.

Figure 2A:
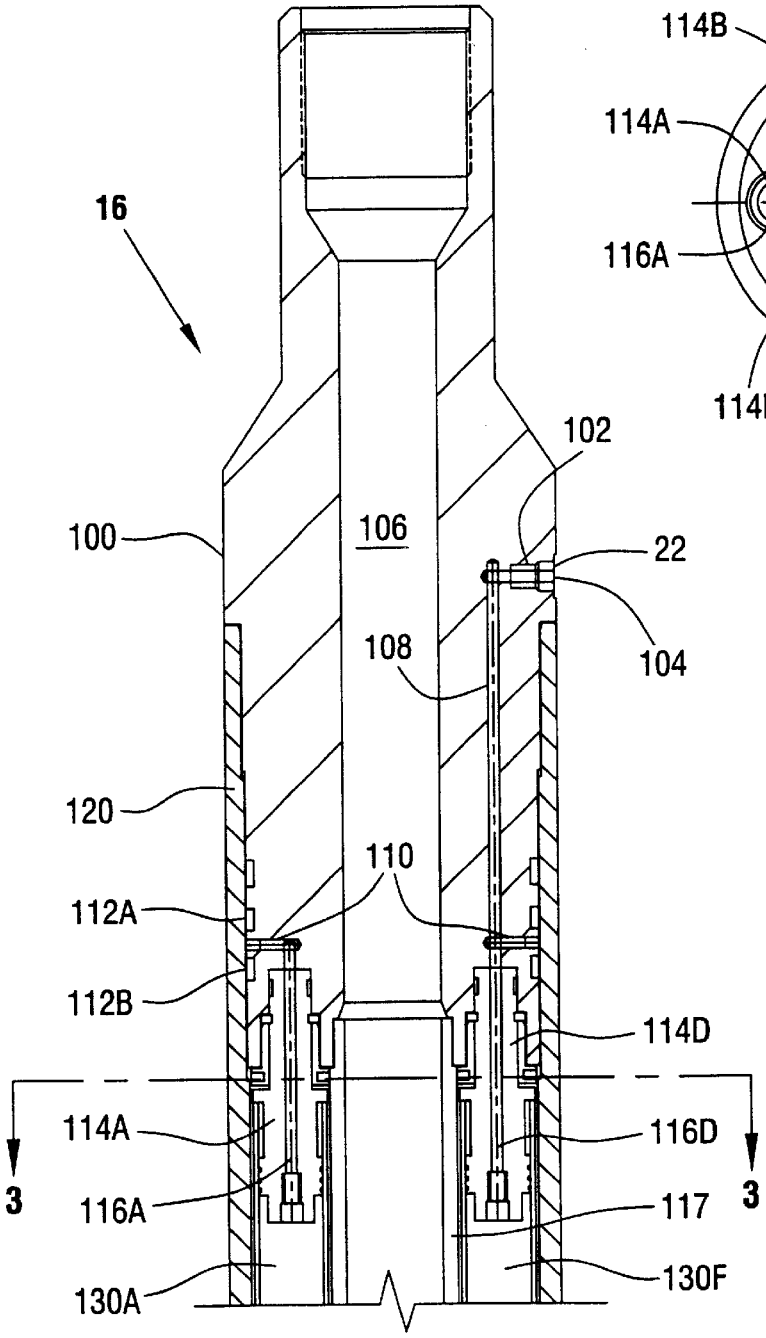
FIGS. 2A–2B are a longitudinal sectional view of a sampler tool in accordance with an embodiment.
Figure 2B:
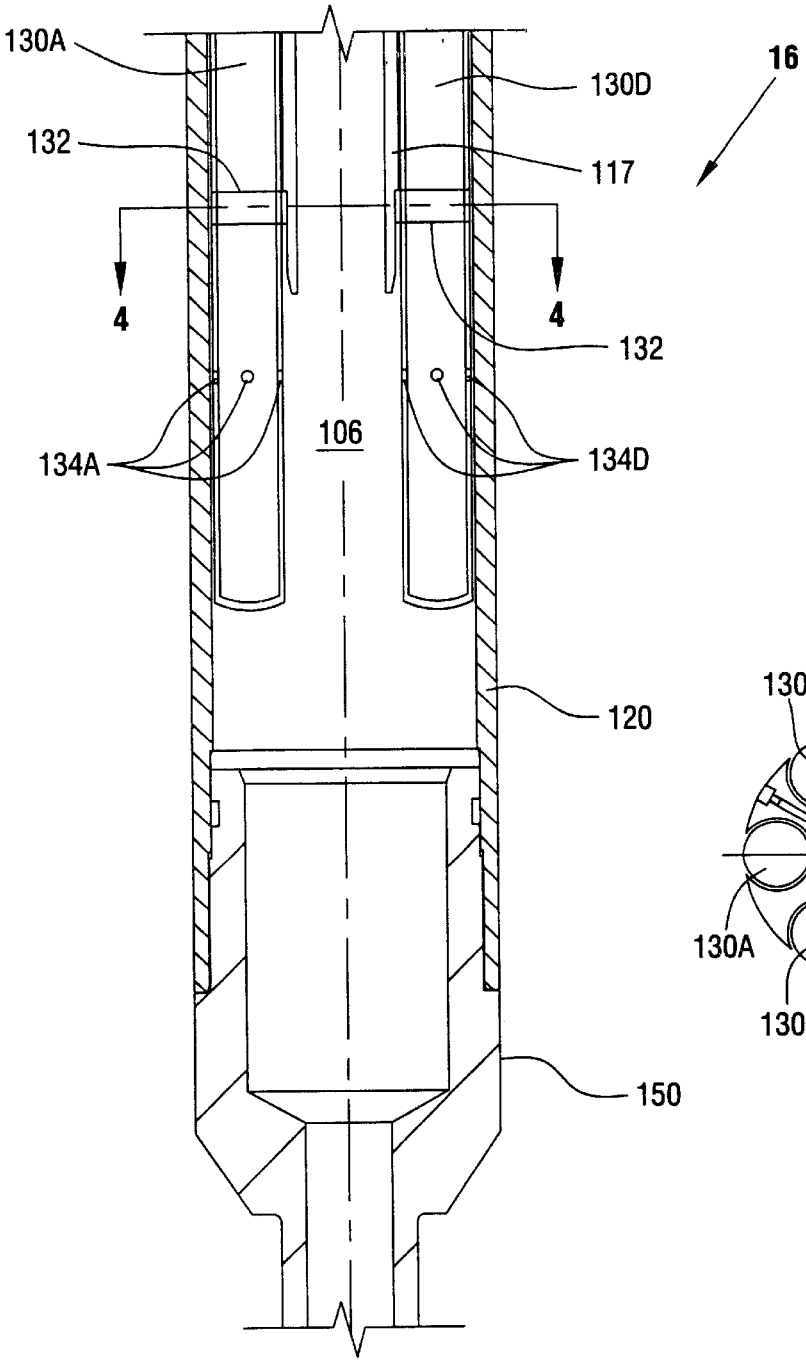

Referring to FIGS. 2A–2B, the sampler tool 16 in accordance with an elevated pressure-activated embodiment includes a carrier having a top sub 100, a bottom sub 150, and a housing section 120 coupled between the top and bottom subs 100 and 150. An inner bore 106 is defined through the sampler tool carrier and includes an inner passageway of the top sub 100, an inner passageway of a mandrel 117, and an inner passageway of the bottom sub 150. According to one embodiment, the sampler tool 16 includes a rupture disk mechanism including a rupture disk 102 mounted in a rupture disk retainer 104. The rupture disk mechanism is positioned inside the port 22 of the sampler tool 16 to block fluid flow from the annular region 18 (FIG. 1) into a longitudinal conduit 108 in the top sub 100. The longitudinal conduit 108 extends to a circumferential groove 110 defined around the circumference of the top sub 100. The groove 110 is covered by the housing section 120 and sealed by O-ring seals 112A and 112B.

Figure 3:
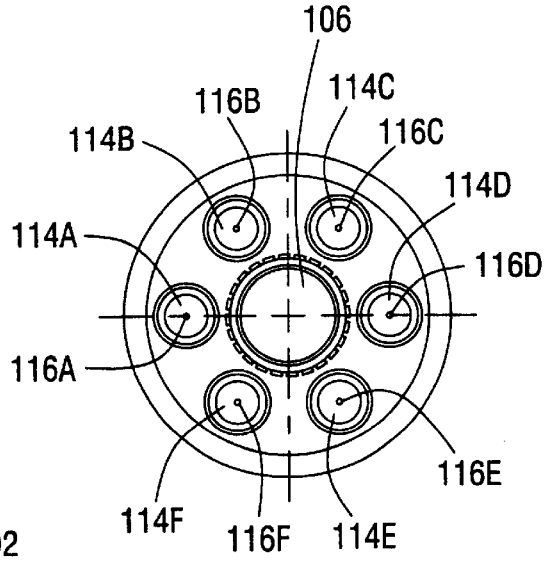
FIGS. 3 and 4 are cross-sectional views of the sampler tool of FIGS. 2A–2B.
Figure 4:
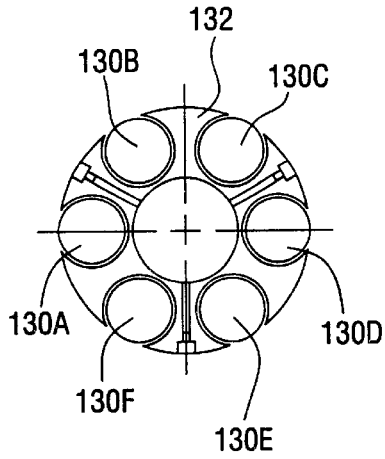

The housing section 120 and the mandrel 117 define an annular region inside the sampler tool 16 in which one or more sampler devices may be positioned. In the illustrated embodiment, six sampler devices 130 are positioned in the annular region. The circumferential groove 110 is arranged to communicate fluid in the longitudinal conduit 108 to passages 116A–116F in adapters 114A–114F (FIG. 3). The adapters 114A–114F are coupled to respective sampler devices 130A–130F (FIG. 4). The sampler devices 130A–130F are positioned between the inside of the housing section 120 and the outside of the mandrel 117 of the sampler tool 16 by a centralizer 132. Before the rupture disk 102 is ruptured, the conduit 108, groove 110, and passages 116A–116F may be filled with air (or other suitable fluid).

Figure 5:
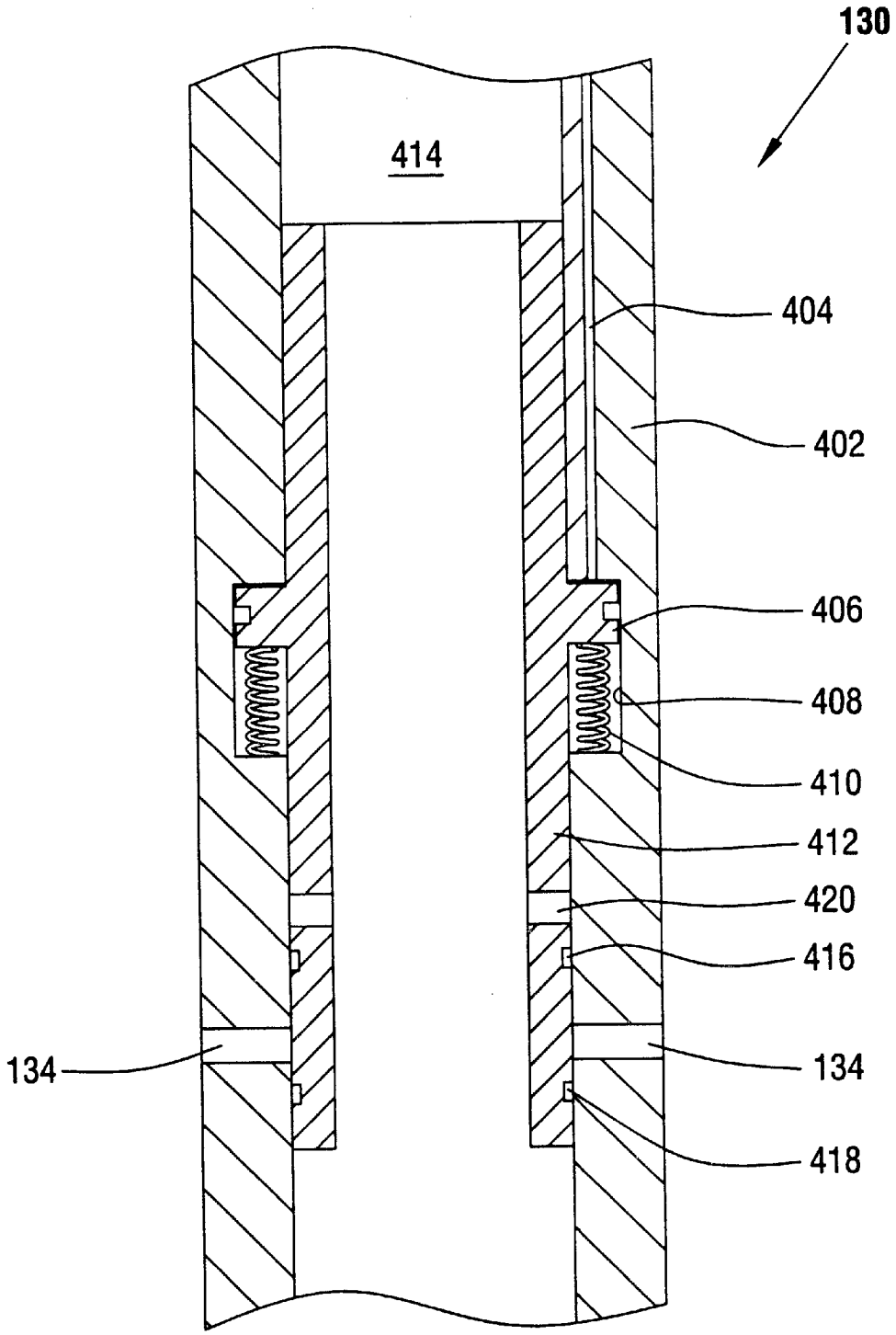
FIG. 5 illustrates a sleeve valve assembly in the sampler tool of FIGS. 2A–2B.

As shown in FIG. 2B, each of the sampler devices 130 includes a corresponding set of one or more inlet ports 134A–134F (FIG. 4). During run-in, the ports are closed off by corresponding flow control devices, which may be sleeve valves or disk valves. An example of a sleeve valve is illustrated in FIG. 5, and examples of disk valves are discussed in U.S. patent application Ser. No. 09/243,401, entitled "Valves for Use in Well, filed Feb. 1, 1999, now U.S. Pat. No. 6,328,112 , which is hereby incorporated by reference. The valves are actuatable to open the ports 134 to enable well fluids in the inner bore 106 to flow into the sampler devices 130.

In operation, according to one embodiment, the test string including the sampler tool 16 is run into the wellbore 10, with the ports of the sampler tool 16 closed to prevent well fluids from entering chambers in the sampler tool 16. Once the test string with the sampler tool 16 has been lowered to a desired location, an elevated fluid pressure may be applied in the annular region 18 (FIG. 1) that is above the threshold pressure needed to rupture the rupture disk 102. Once the rupture disk 102 is ruptured, the annular fluid pressure is communicated to the longitudinal conduit 108, which in turn is communicated through the circumferential groove 110 and passages 116A–116F to the respective sampler devices 130A–130F. The elevated annular fluid pressure when communicated to the sampler devices 130A–130F actuates a sampler activation mechanism in each of the sampler devices 130A–130F to open up respective valves corresponding to ports 134A–134F to allow fluid in the carrier inner bore 106 to flow into the sampler devices.

In another embodiment, plural rupture disk assemblies may be used to operate the sample devices. The plural rupture disk assemblies may be ruptured at different pressures.

Referring to FIG. 5, a portion of the sampler device 130 proximal the one or more ports 134 is illustrated. The sampler device 130 includes a housing 402 in which a longitudinal fluid conduit 404 may extend. The longitudinal fluid conduit 404 is adapted to receive fluid pressure from the port 22 through conduits 108 and 116 (FIG. 2A). The longitudinal fluid conduit 404 leads to one side of a piston 406. The other side of the piston 406 is in communication with a lower pressure chamber 408 (e.g., an atmospheric chamber). A spring 410 may also be positioned in the chamber 410.

The piston 406 is part of a sleeve valve assembly including a sleeve 412 having two vertically displaced O-ring seals 416 and 418. In the position illustrated in FIG. 5, the O-ring seals 416 and 418 are on either side of the one or more ports 134 to block fluid communication between the outside of the sampler device 130 and an inner chamber 414 of the sampler device 130.

To actuate the sleeve 412 downwardly, an elevated fluid pressure is applied down the longitudinal conduit 404 to apply a force against the atmospheric chamber 408 and the spring 410. The elevated pressure moves the piston 406 and sleeve 412 downwardly. Once the O-ring seal 416 moves past the one or more ports 134, corresponding one or more ports 420 in the sleeve 412 are lined up with the ports 134 to enable fluid communication between the sampler device exterior (containing well fluids) and the sampler device chamber 414. After the desired fluid samples have been collected, the elevated pressure may be removed from the conduit 404 to enable the spring 410 to push the sleeve 412 upwardly to the closed position.

In further embodiments, one or more disk valves may be used instead of the sleeve valve 412 with a similar actuator.

Other types of sampler activating mechanisms may be used in further embodiments. For example, instead of using a rupture disk assembly that is activable by an elevated fluid pressure, a sampler device in accordance with another embodiment may include a sampler activating mechanism that is responsive to a low-level pressure pulse signal created in the annular region 18. This type of sampler activating mechanism may include a pressure pulse transducer that is responsive to a pressure pulse of a predetermined magnitude and duration. Such pressure pulse actuated mechanisms are described in U.S. Pat. Nos. 4,896,722; 4,915,168 and Reexamination Certificate B1 U.S. Pat. Nos. 4,915,168; 4,856,595; 4,796,699; 4,971,160; and 5,050,675, which are hereby incorporated by reference.

One pressure transducer may be used to activate plural sampler devices, or alternatively, plural pressure transducers may be used to activate the plural sampler devices.

Figure 6:
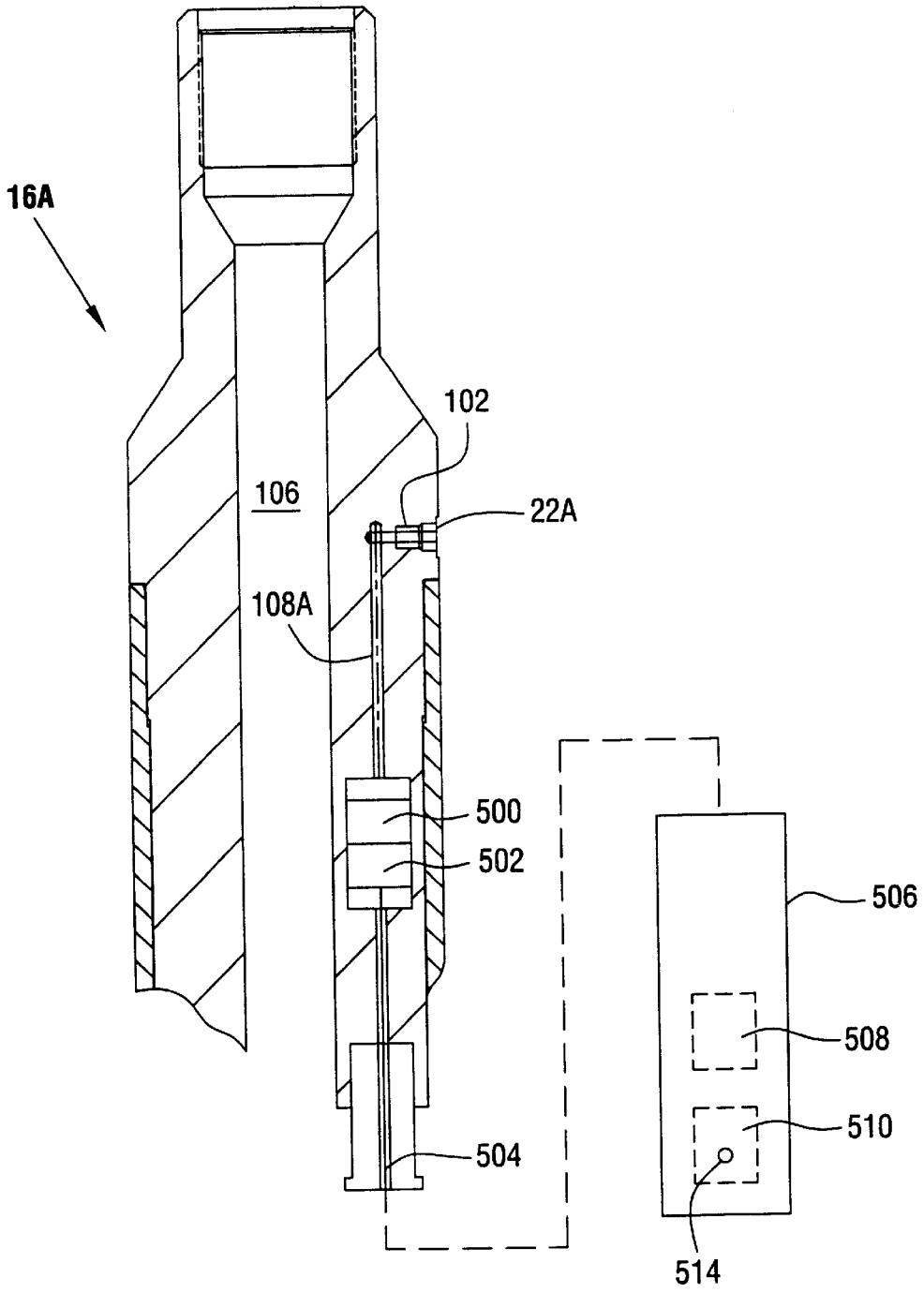
FIGS. 6–7 illustrate a sampler tool having an activating mechanism in accordance with another embodiment.
Figure 7:
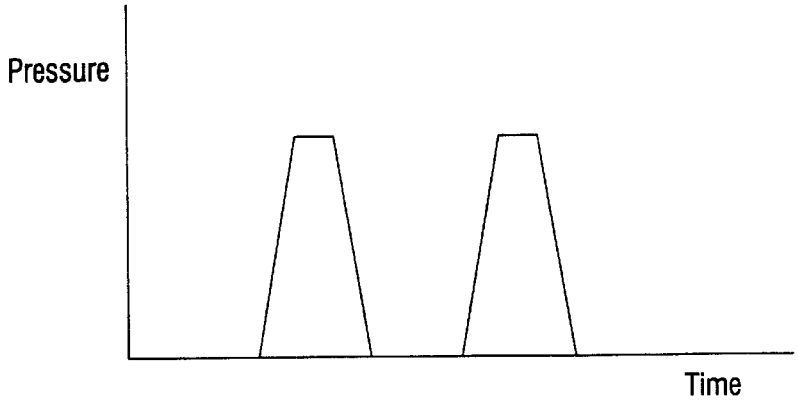

Referring to FIGS. 6–7, a sampler tool 16A with a pressure pulse signal activating mechanism is illustrated. The sampler tool 16A includes a port 22A without a rupture disk mechanism blocking communication of fluid pressure in the tubing-casing annulus 18. Pressure pulse signals (such as ones shown in FIG. 7) transmitted in the annulus 18 (from the surface) are communicated through the port 22A and down the conduit 108A to a pressure pulse command sensor (or pressure transducer) 500. Sensed signals are communicated to a controller 502 (e.g., a microprocessor, microcontroller, or other integrated circuit chip or other type of device or system). In response, the controller 502 sends command signals down an electrical line 504 to a sampler device 506. Each sampler device 506 includes a solenoid actuator 508 that is adapted to actuate a flow control device 510 (e.g., a sleeve valve or disk valve) that controls flow through one or more ports 514.

If the sampler tool 16A includes plural sampler devices 506, each may include a command sensor responsive to pressure pulse signals of different amplitudes or frequencies. Electrical power for the sensor 500, controller 502, and solenoid actuator 508 may be provided by a power supply (not shown).

In another embodiment, the activating mechanism in each sampler device 130 may include a timer (implemented either as an electrical or mechanical timer). The timers in the sampler devices 130 may be set to expire after the same time period or after different time periods. In this embodiment, the timer in each sampler device 130 may be run into the wellbore in "slip mode" (that is, deactivated). This may be done, for example, by using a rupture disk (such as rupture disk 102 in FIG. 2A) to block fluid pressure from the timer. To start the timer, the rupture disk 102 may be ruptured with an elevated pressure so that the elevated pressure may be communicated through the conduit 108, groove 110, passages 116A–116F (FIG. 2A) to the timers included with the activating mechanisms of the sampler devices. The elevated pressure may be communicated to a pressure switch (of a mechanical timer) or an electrical contact (of an electrical timer) to start the timers. After each timer expires, the corresponding activating mechanism of each sampler device is actuated.

Figure 8:
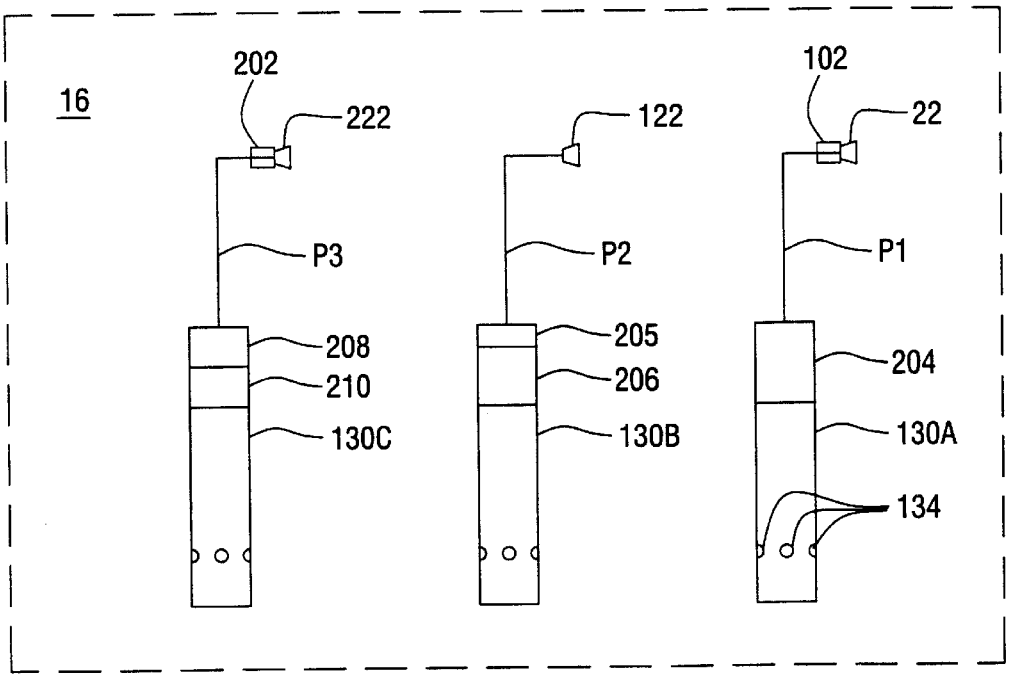
FIG. 8 illustrates activating mechanisms for use in the sampler tool of FIGS. 2A–2B in accordance with another embodiment.

Referring to FIG. 8, in one example, a sampler tool 16 may include sampler devices 130A, 130B, and 130C including different types of sampler activating mechanisms. The sampler device 130A may be activated by an activating mechanism 204 that is responsive to an elevated fluid pressure in the annular region 18 (such as the one shown in FIGS. 2A–2B). The elevated pressure ruptures the rupture disk 102 to allow communication of the elevated fluid pressure through path P1 (including the conduit 108, groove 110, and passage 134 as illustrated in FIG. 2A, for example) to the activating mechanism 204.

The second sampler device 130B may include an activating mechanism 206 that is attached to a pressure transducer 205 to receive low-level pressure pulses from the annular region 18 through the port 122 and path P2. A third sampler device 130C may be activated by a mechanism 210 that is coupled to a timer 208. The timer 208 is deactivated while a rupture disk 202 remains intact. Once an elevated pressure (which may be less than, the same as, or greater than the elevated pressure employed to rupture the disk 102) is applied, the disk 202 is ruptured and the pressure is communicated through a port 222 and a path P3 to start the timer 208.

In a variation of the FIG. 8 embodiment, each of the P1, P2, and P3 paths may be coupled to additional sampler devices 130.

Figure 9:
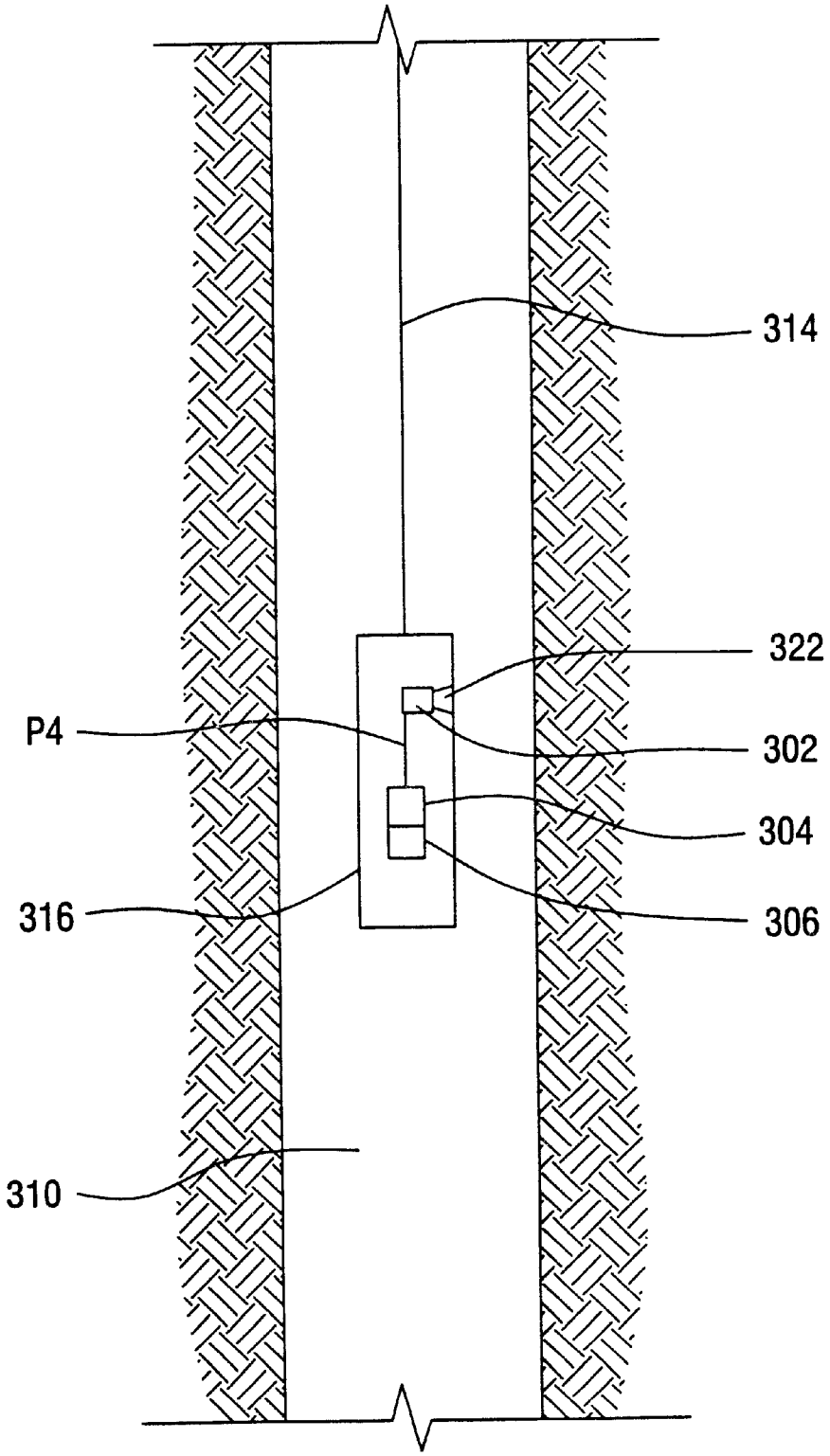
FIG. 9 illustrates a sampler tool according to yet another embodiment run on a slickline.

Referring to FIG. 9, in another embodiment, a sampler tool 316 may be lowered into a wellbore 310 on a slickline 314. The sampler tool 316 may include a port 322 exposed to the wellbore fluid pressure. The sampler tool 316 may include an activating mechanism 306 that is coupled to a timer 304. The timer 304 is coupled to a fluid path P4 that may be initially blocked from wellbore fluid by a rupture disk 302 placed inside the port 322. The rupture disk 302 may be set to rupture at a predetermined fluid pressure that may occur at a predetermined depth (e.g., hydrostatic pressure). Once the rupture disk 302 ruptures, the wellbore fluid pressure is communicated through the port 322 and path P4 to start the timer 304. Expiration of the timer 304 causes the activating mechanism 306 to be actuated.

In a variation of the FIG. 9 embodiment, the timer 304 may be removed so that a predetermined wellbore fluid pressure that may exist at a certain depth may actuate the activating mechanism 306.

Some embodiments of the invention may have one or more of the following advantages. A remote, non-electrical, actuation mechanism is provided to actuate downhole sampler devices. Independent actuation mechanisms may be provided to actuate the downhole samplers at different times. Multiple samplers that may be independently activated provide for improved redundancy in sampling downhole fluid. The sampler tool according to some embodiments may be used in a relatively high-pressure and high-temperature well, which may be too harsh an environment for electrically activated sampler devices run on wireline cables. Reliability in activating the sampler devices may be improved since some predetermined event must occur (e.g., an applied elevated pressure, an applied pressure pulse, or a wellbore fluid pressure at predetermined depths) before the sampler activating mechanisms are enabled for operation.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A tool for use in a wellbore, comprising:

a sampler device including one or more ports, a flow control device to control flow through the one or more ports, and an activating mechanism to control the flow control device; and an assembly including a rupture disk mechanism and a fluid path between the rupture disk mechanism and the activating mechanism, the rupture disk mechanism adapted to block communication of fluid pressure to the activating mechanism, wherein the assembly includes a sub in which the rupture disk mechanism and fluid path are located, wherein the sub defines an inner bore; and a housing and a mandrel defining an annular region in which one or more sampler devices may be positioned.

2. The tool of claim 1, wherein the mandrel defines an inner bore coaxial with the inner bore of the sub.

3. The tool of claim 1, comprising plural sampler devices.

4. The tool of claim 1, further comprising one or more adapters to couple the fluid path to the one or more sampler devices.

5. The tool of claim 1, wherein the rupture disk mechanism is adapted to be ruptured by an elevated fluid pressure.

6. The tool of claim 5, wherein fluid pressure is communicated down the fluid path to the sampler device once the rupture disk mechanism is ruptured.

7. The tool of claim 1, wherein the flow control device includes one or more sleeve valves.

8. A tool for use in a wellbore, comprising:

a sampler device including one or more ports, a flow control device to control flow through the one or more ports, and an activating mechanism to control the flow control device;

an assembly including a rupture disk mechanism and a fluid path between the rupture disk mechanism and the activating mechanism, the rupture disk mechanism adapted to block communication of fluid pressure to the activating mechanism; and a second sampler device including a second activating mechanism, the assembly further including a second rupture disk mechanism and a second fluid path between the second rupture disk mechanism and the second activating mechanism.

9. The tool of claim 8, wherein the first and second rupture disk assemblies are adapted to rupture at different pressures.

10. A tool for use in a wellbore, comprising:

a plurality of devices including a first device and a second device, each including an activating mechanism;

a first port adapted to receive fluid pressure;

a rupture disk assembly between the first port and the activating mechanism of the first device; and a second port adapted to receive a pressure pulse signal, the activating mechanism of the second device in communication with the second port and actuatable by the pressure pulse signal.

11. The tool of claim 10, wherein the first device activating mechanism includes a timer.

12. A tool for use in a wellbore, comprising:

a device including an activating mechanism;

a timer coupled to the activating mechanism; and a port assembly adapted to block fluid pressure from the timer to maintain the timer deactivated, the port assembly including a rupture disk that is capable of being ruptured by a fluid pressure greater than a predetermined level to allow communication of fluid pressure to start the timer.

13. The tool of claim 12, wherein the device includes a sampler device.

14. The tool of claim 13, wherein the sampler device includes at least one port and at least one flow control device to control flow through the at least one port.

15. The tool of claim 14, wherein the at least one flow control device includes at least one of a disk valve and a sleeve valve.

16. A tool string for use in a wellbore, comprising:

a slickline;

a device attached to the slickline and including a plurality of activating mechanisms, the device including one or more ports adapted to receive fluid pressure and a plurality of rupture disk assemblies mounted in the one or more ports to block the fluid pressure from the activating mechanisms, the rupture disk assemblies adapted to be ruptured by respective fluid pressures in the wellbore.

17. The tool string of claim 16, wherein the device further comprises fluid paths each connecting a respective rupture disk assembly and activating mechanism.

18. The tool string of claim 16, wherein the activating mechanisms are adapted to be activated by different pressures.

19. The tool string of claim 18, wherein the device further comprises a plurality of samplers adapted to be actuated by respective activating mechanisms.

20. The tool string of claim 19, wherein each of the samplers comprises a port and a flow control device actuatable by the respective activating mechanism.

21. The tool string of claim 16, wherein the device further comprises a plurality of samplers adapted to be actuated by respective activating mechanisms.

22. A method of operating sampler devices for use in a wellbore, comprising:

lowering the sampler devices on a tool string into the wellbore;

applying a first pressure into the wellbore to rupture a first rupture disk assembly;

providing the first pressure to a first activating mechanism of a first flow control device in a first sampler device, the first flow control device blocking fluid from entering through one or more ports in the first sampler device when closed, the first pressure activating the first activating mechanism to open the first flow control device;

applying a second, different pressure into the wellbore to rupture a second rupture assembly; and providing the second pressure to a second activating mechanism of a second flow control device in a second sampler device, the second flow control device blocking fluid from entering through one or more ports in the second sampler device when closed, the second pressure activating the second activating mechanism to open the second flow control device.

* * * * *